US006634308B1

(12) United States Patent
Martin

(10) Patent No.: US 6,634,308 B1
(45) Date of Patent: Oct. 21, 2003

(54) PRESSER FOOT FOR HIGH SEAM STITCHING

(76) Inventor: Alan Roy Martin, 2761 Rosewood La., Newton, NC (US) 28658

( * ) Notice: Subject to any disclaimer, the term of this patent is extended or adjusted under 35 U.S.C. 154(b) by 0 days.

(21) Appl. No.: 10/143,777

(22) Filed: May 3, 2002

(51) Int. Cl.[7] ..... D05B 29/08
(52) U.S. Cl. ..... 112/235
(58) Field of Search ..... 112/235, 236, 112/240, 237, 238

(56) References Cited

U.S. PATENT DOCUMENTS 2,487,285 A * 11/1949 Voigt
2,932,269 A * 4/1960 Kuhar
3,796,173 A * 3/1974 Godsen
3,823,679 A * 7/1974 Meier
5,537,943 A * 7/1996 Bartholoma et al.

* cited by examiner

*Primary Examiner*—Ismael Izaguirre
(74) *Attorney, Agent, or Firm*—Mills Law Firm PLLC

(57) ABSTRACT

A presser foot for a sewing machine is provided with a pair of forwardly mounted, pivotal pressure shoes having inclined front and rear surfaces for maintaining continuous contact with the sewn material while stitching across raised, high seam material areas.

5 Claims, 7 Drawing Sheets

FIG. 6
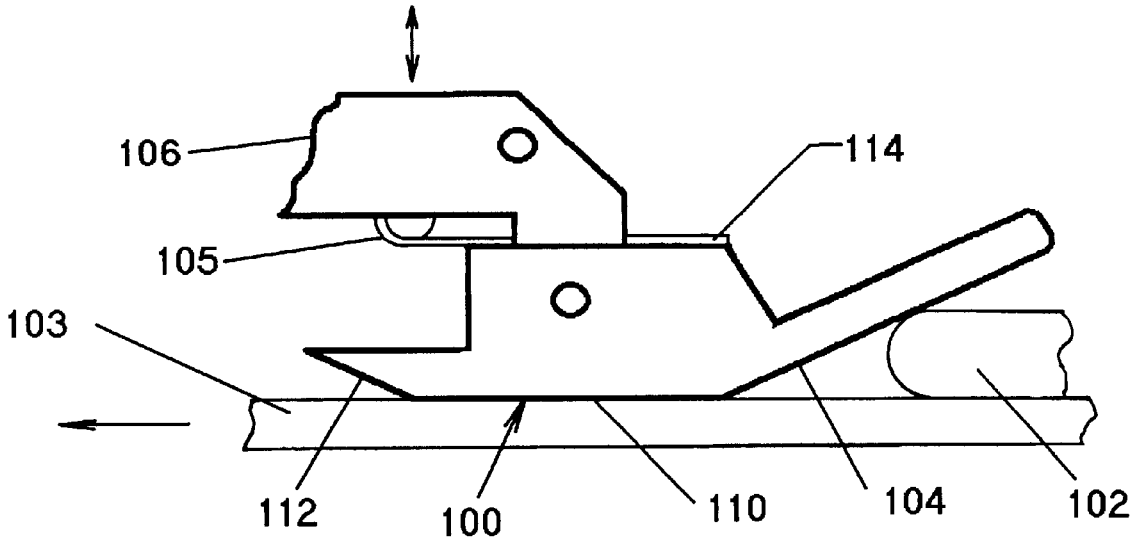
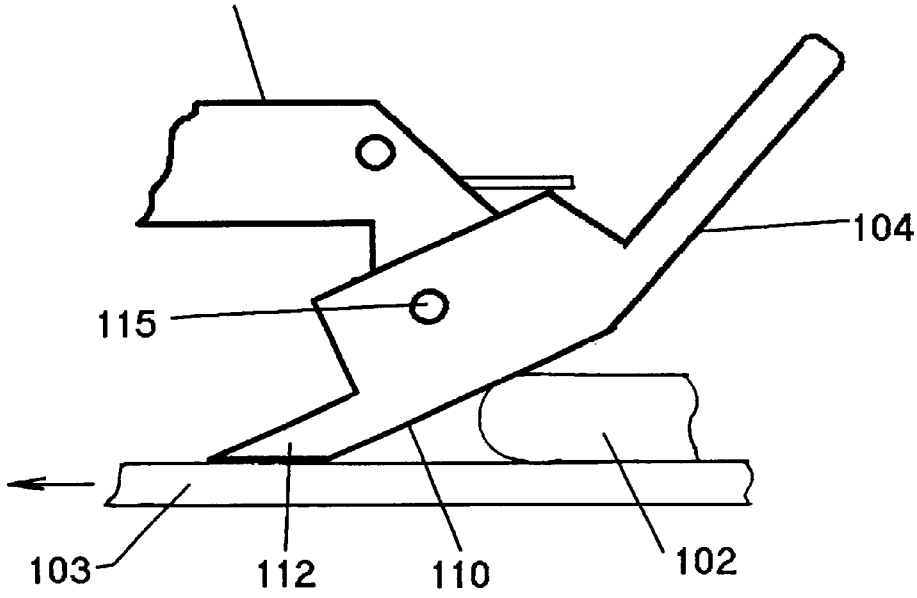
FIG. 7

FIG. 8
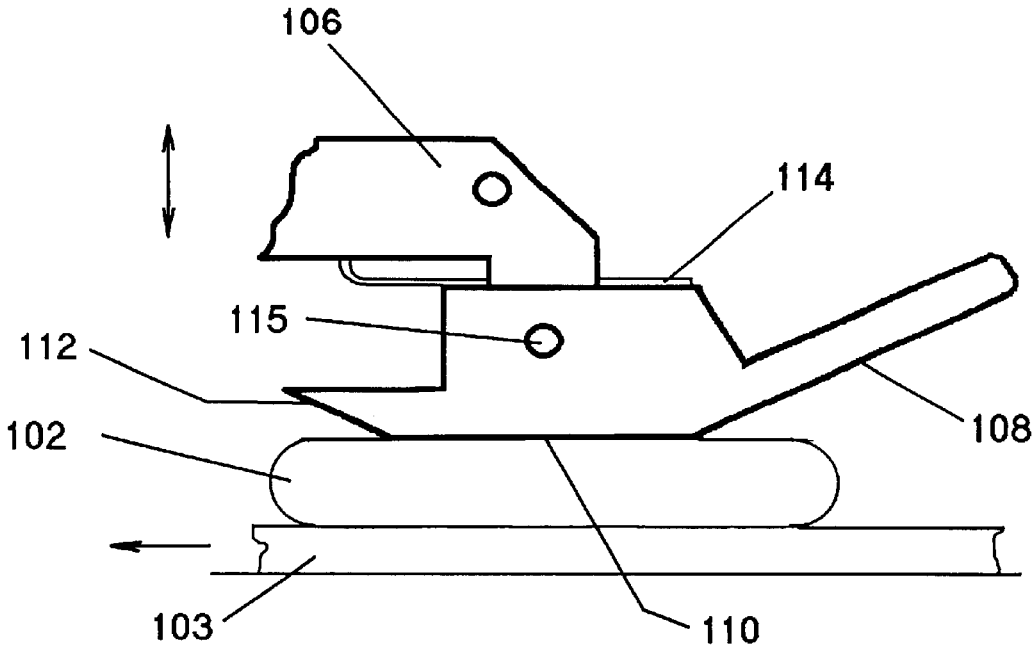
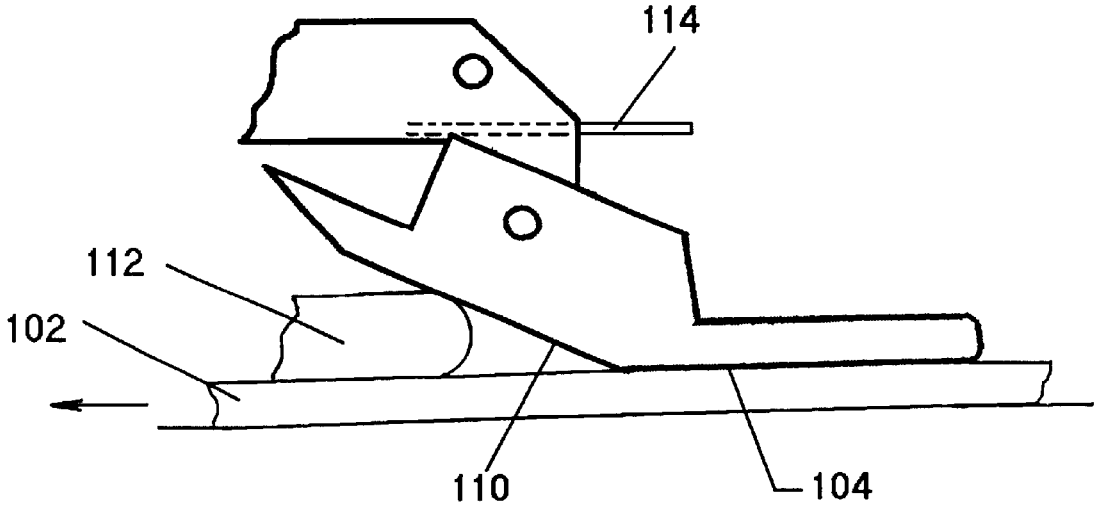
FIG. 9

PRESSER FOOT FOR HIGH SEAM STITCHING

FIELD OF THE INVENTION

The present invention relates to presser feet for sewing machines and, in particular, to a presser foot for traversing a raised area without collateral noise and a loss of forward stitching speed.

BACKGROUND OF THE INVENTION

Sewing machines are generally provided with presser feet for holding the sewn material as the sewing needle is withdrawn. The presser foot is attached to a presser bar, which moves in alternate phase opposition to the needle carried by a needle bar. The foregoing arrangement works highly satisfactory in most instances. Difficulties, however, are presented when traversing raised areas wherein a cross panel is present, oftentimes referred to as a high seam. Generally, the presser foot will not ride over the raised area requiring interruption of the sewing, manually raising the presser bar to clear the raised area, stitching slowly thereacross, lowering the presser bar, and resuming normal stitching thereafter. In addition to the loss in sewing productivity, the raised presser bar during this period generates considerable undesirable noise.

Efforts have been made to overcome some of the above limitations including provisions for automatically raising the presser foot as disclosed in U.S. Pat. No. 5,899,157 to Kurono et al. Other provisions have been made as disclosed in U.S. Pat. No. 5,590,614 to Murata et al for preventing operation if the presser foot is not adequately cushioned. Additional presser foot control is disclosed in U.S. Pat. No. 5,718,182 to Nakayama et al. wherein a downwardly biased presser foot contacts the material during operation. The pivot axis is aligned with the presser bar and resent problems in high seam applications inasmuch as the reciprocating presser foot in the downward position engages the raised panel and precludes continued movement. Moreover, the trailing surface of the presser foot abruptly leaves the raised area and may create stitching discontinuities.

In view of the foregoing, it would be desirable to provide a presser foot for use in high seam applications wherein the foot freely advances over a raised area maintaining normal stitching speed and continuous affirmative contact with the material.

SUMMARY OF THE INVENTION

The foregoing objectives are accomplished in the present invention by a presser foot having a pair of spring biased pressure shoes having inclined leading and trailing ramped surfaces forward of the presser bar that allow the shoes to traverse and conform to a high seam area while maintaining continuous contact with the material. The shoes have a center horizontal lower presser surface for normal engagement with the material. As the leading surface engages the raised area, the shoes are reversely pivoted against spring biasing to conform to the material elevations. The shoes are normally biased to the horizontal position for traversing the raised area and reversely downwardly pivoted to bridge the material elevations upon exiting the raised area. By locating the shoes forward of the presser bar, continuous tracking with the material is achieved. Resultant, sewing speed may be maintained and the continuous pressure against the material reduces the noise attendant conventional raised presser foot positioning.

Accordingly, it is an object of the present invention to provide a presser foot for high seam sewing that allows sewing speeds to maintained without interruption for repositioning the presser foot.

Another object of the invention is to provide a presser foot that maintains continuous contact with the sewn material while traversing raised stitching area thereby eliminating collateral noise.

A further object of the invention is to provide a presser foot for a sewing machine having inclined leading and trailing surfaces forward of the presser bar that conform to changes in sewing elevations without requiring a slowing of stitching speed or presser foot repositioning.

DESCRIPTION OF THE DRAWINGS

The above and other objects and advantages of the present invention will become apparent upon reading the following detailed description taken in conjunction with the accompanying drawings in which:

FIG. 6 is a schematic view of the presser foot advancing toward a raised panel;

FIG. 7 is a schematic view of the presser foot advancing over a raised panel;

FIG. 8 is a schematic view of the presser foot traversing the raised panel; and FIG. 9 is a schematic view of the presser foot exiting the raised panel.

DETAILED DESCRIPTION OF THE PREFERRED EMBODIMENTS

Figure 1:
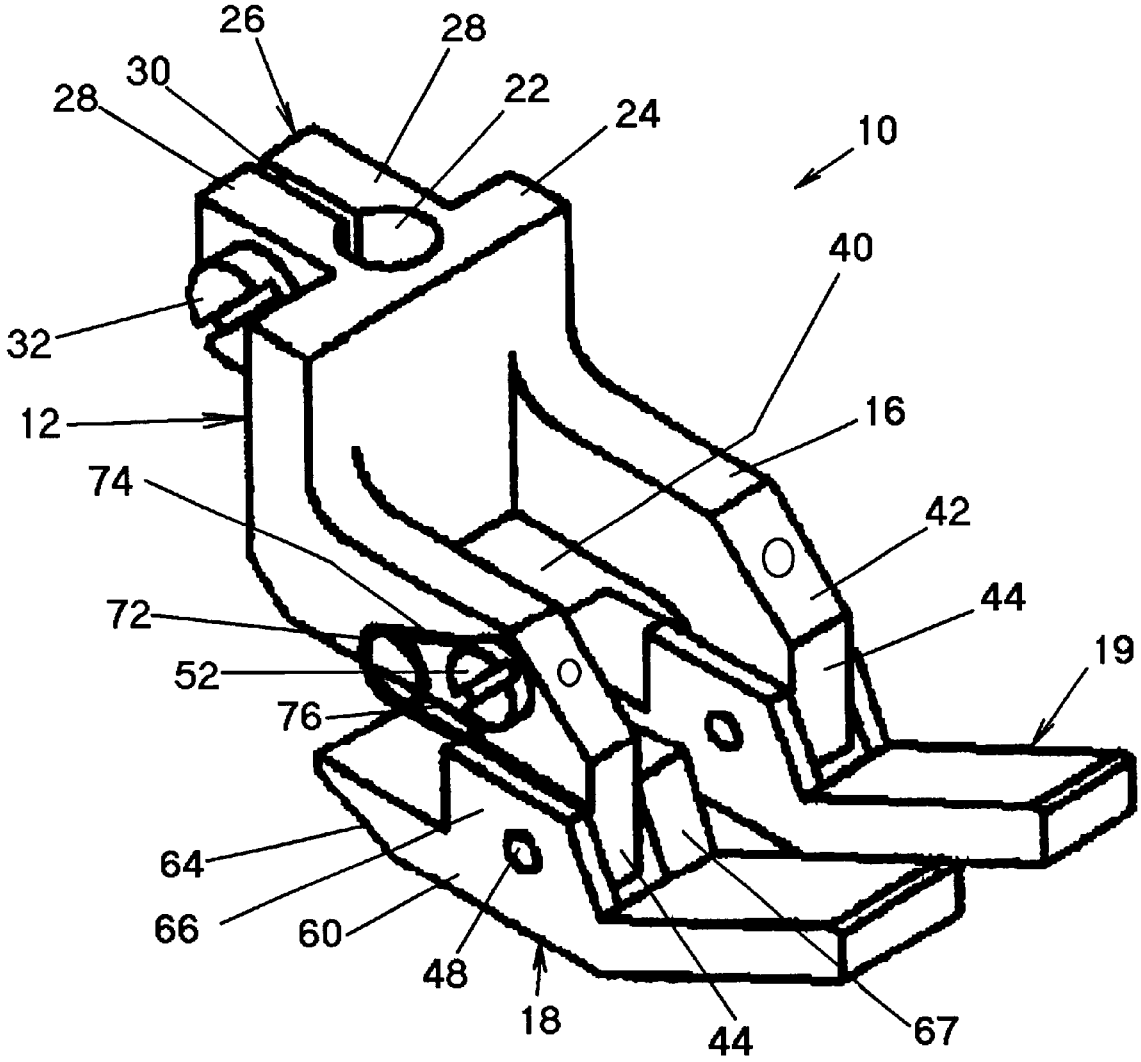
FIG. 1 is a perspective view of a presser foot in accordance with an embodiment of the invention.

Referring to the drawings for the purpose of describing the preferred embodiment and not for limiting same, FIG. 1 illustrates a presser foot 10 having a support yoke 12 that is adapted to be attached to a reciprocable presser bar, not shown, and carries at laterally spaced legs 16 a pair of pivotal presser shoes 18 and 19.

The support yoke 12 includes a rectangular body 20 having a vertical bore 22 extending centrally through the top wall 24 for receiving the lower end of the presser bar. The body 20 includes a split rearwardly projecting tab 26 having tab sections 28 separated by a vertical slot 30, which intersects the bore 22. A threaded fastener 32 includes a shank that extends through an aperture in the adjacent tab section for clamping the tab sections to thereby engage the presser bar and retain the presser foot thereon. It will be appreciated that the foregoing mounting is typical of one version of the presser foot attachment and that other conventional presser bar attachments may be accomplished in any acceptable manner.

Figure 2:
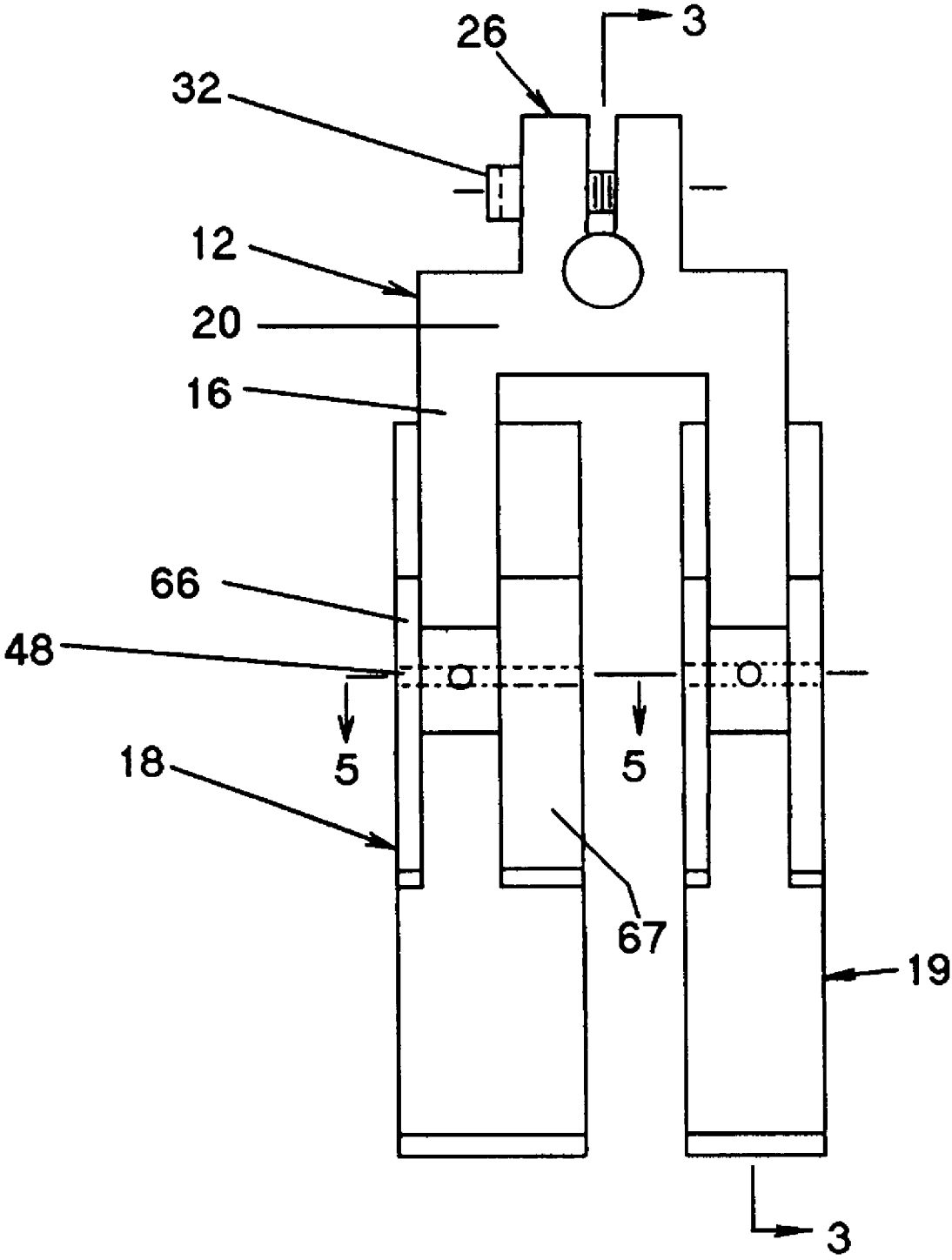
FIG. 2 is top view of the presser foot shown in FIG. 1.
Figure 3:
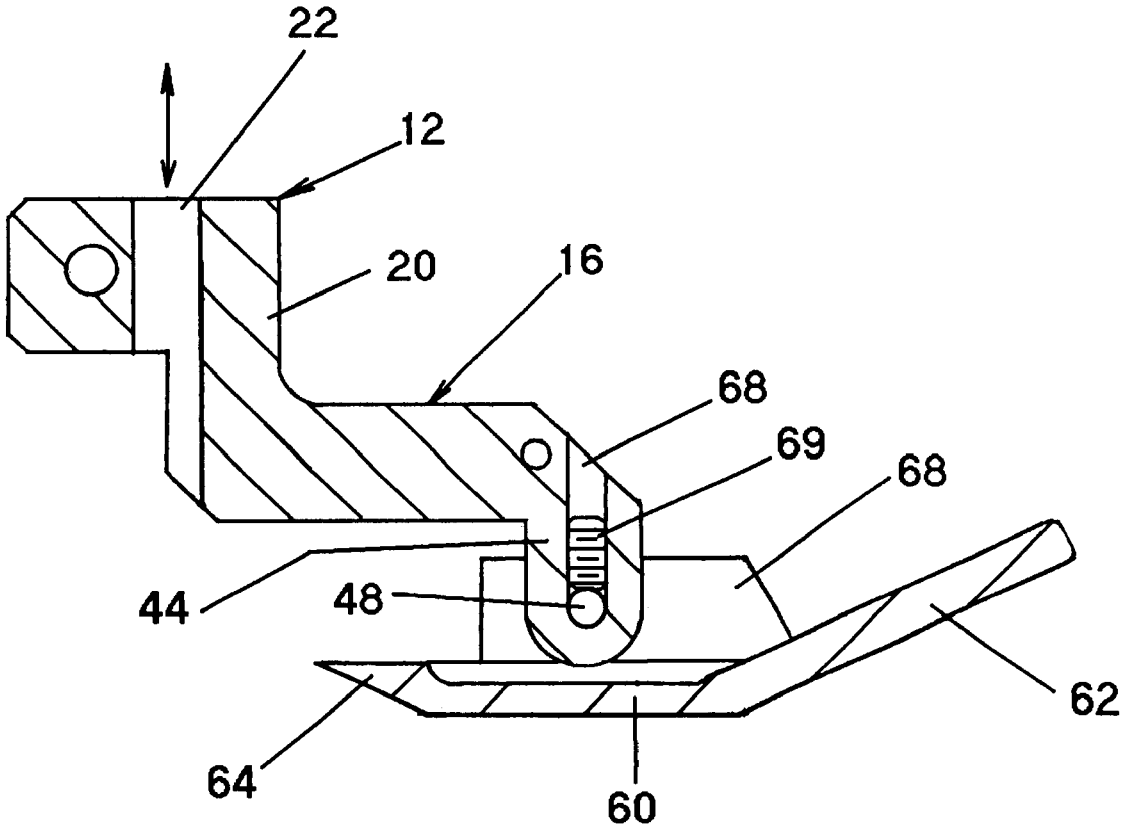
FIG. 3 is a side cross sectional view taken along line 3—3 in FIG. 2.
Figure 4:
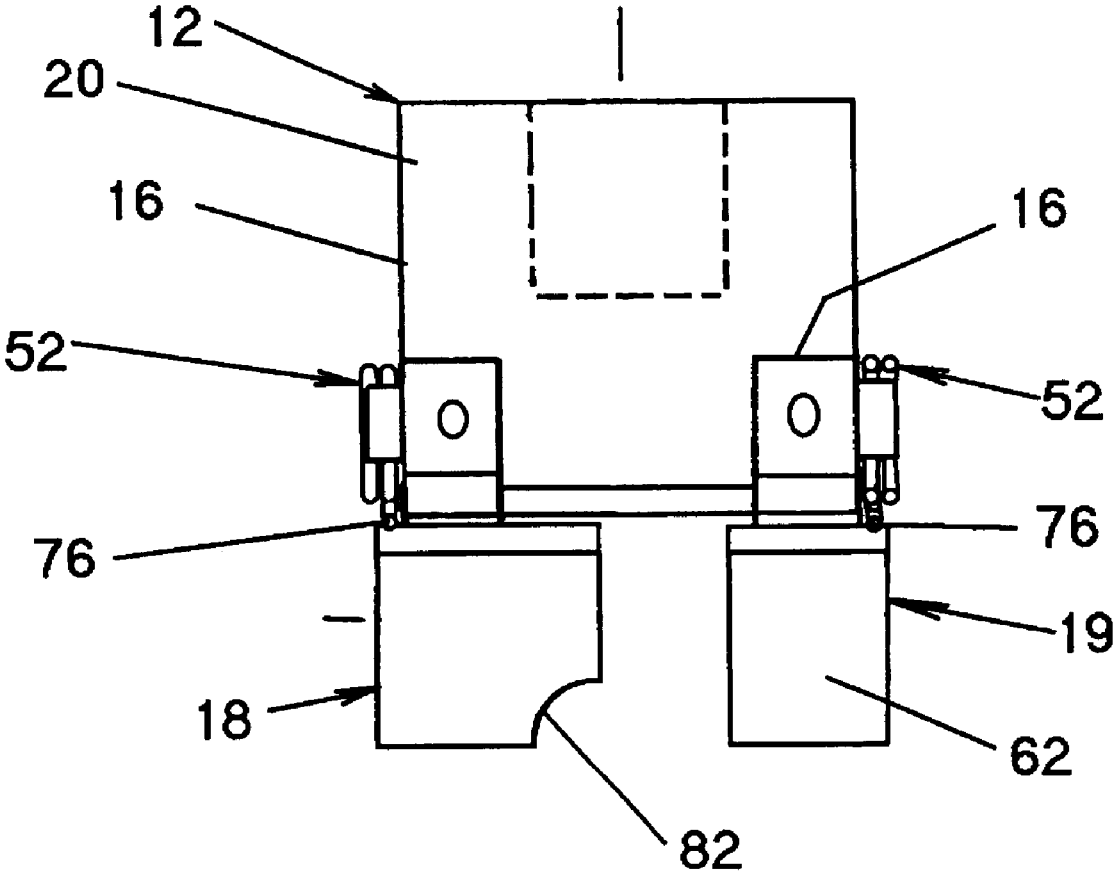
FIG. 4 is front elevational view of the presser foot.

Referring additionally to FIGS. 2 through 4, the support arms 16 extend forwardly from the lower outer surface of the body 20 and are laterally spaced by a center groove 40. Each arm 16 frontally terminates at a beveled tip 42 having a depending knuckle 44 pivotally connected to the shoes 18 and 19 by mounting pin 48. The shoes 18 and 19 each include a horizontal center section 60, an upwardly and forwardly inclined toe section 62, and an upwardly and rearwardly inclined heel section 64. The center section 60 includes upwardly extending, laterally spaced outer and inner flanges 66 and 67 defining a transverse groove in which the knuckles 44 are slidably received. By locating the pin 48 forwardly on the arms, the shoes are located entirely forwardly of the reciprocal axis of the presser bar.

Figure 5:
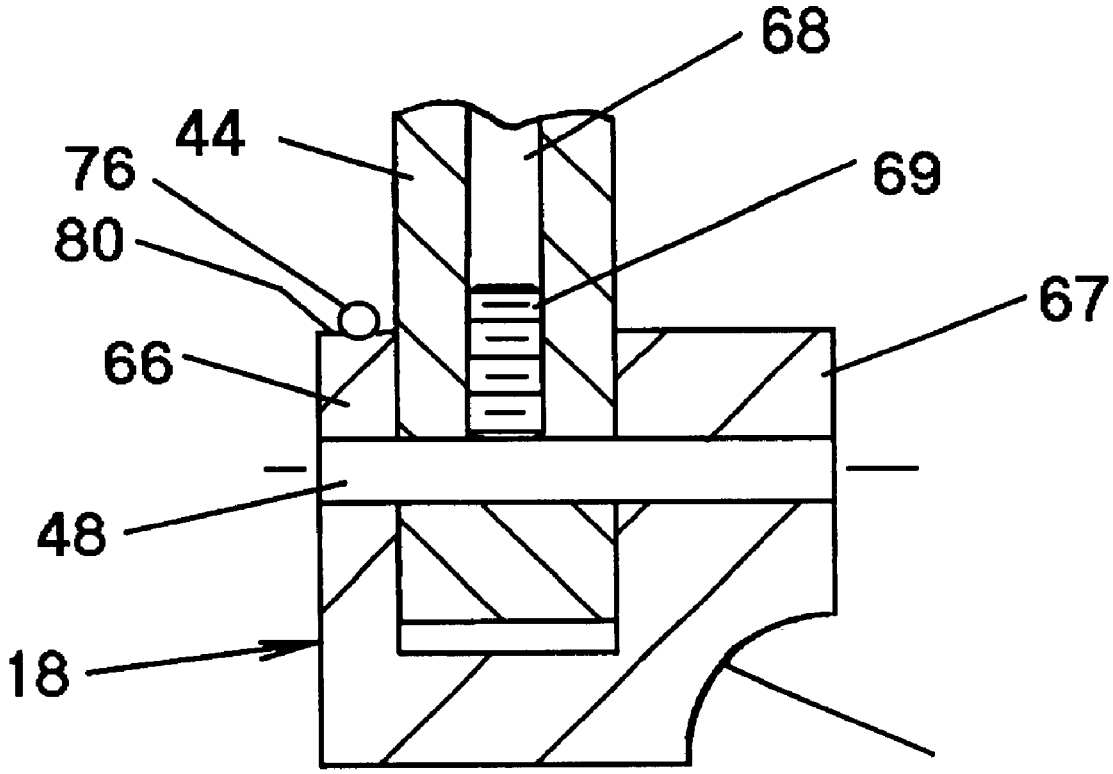
FIG. 5 is an enlarged fragmentary cross sectional view taken along line 5—5 in FIG. 2.

Referring to FIG. 5, the flanges 66, 67 and knuckle 44 have horizontally aligned clearance holes for slidably receiving the mounting pin 48. A vertically threaded hole 68 is formed in the tip 42 of the arm 16 and the knuckle that intersects the mounting pin 48. A set screw 69 is threaded in the hole into engagement to axially fix the pin in the knuckle 44 and permit the shoes to rotate about the pin 48 as shown in FIGS. 6 through 9.

The flanges on the center sections 60 terminate with a horizontal top wall 80 parallel to the bottom surface of the center section 60. The biasing spring 52 includes a center coiled section 72 and outwardly extending upper and lower arms 74 and 76. The upper arm 74 is retained between the outer wall of the arm 16 and the head of the fastener 52. The lower arm 76 is disposed in a transverse groove in the top wall 80 for normally maintaining the horizontal orientation of the shoes, while yieldingly accommodating pivoting of the shoes during sewing operations.

The pressure shoes may be varied within the above criteria to handle differing materials and sewing constructions. In order to handle welts, a semicircular recess 82 may be formed on the inner wall of one of the shoes as shown in FIGS. 4 and 5. The width of the side flange 67 may be increased appropriately to handle the recess. The surface texture of the lower surfaces may also be varied. For example, a smooth surface would be preferred for materials such a leathers, while a roughened or knurled surface would be preferred for certain fabrics.

Referring to FIGS. 6 through 9, in operation as the pressure shoe 100 reaches a transverse raised panel 102 on bottom panel 103 requiring high seam stitching thereover, the toe section 104 engages the leading surface of the panel 102 and effects pivoting of the shoe 100 against the biasing of the spring 105 relative to the presser arm 106. As the stitching and material advance continues, the toe section 104 and the center section 110 progressively slide over the leading edge of the panel until the heel section 112 is adjacent thereto and lies flat on the bottom panel 103 as shown in FIG. 7. Thereafter, the shoe reversely pivots against the biasing of the spring arm 114, lying flat on the raised panel as shown in FIG. 8. The slightly increased resultant elevation of the pivot pin is readily accommodated by the compensating springs in conventional presser bar mechanisms. As the presser shoe leaves the raised panel, the shoe downwardly pivots with the toe section 104 engaging the bottom panel 103, as shown in FIG. 9. Further advances disengage the shoe from the raised panel.

It will be appreciated that at all times during traverse of the raised panel positive contact in maintained between the presser shoe surfaces and the materials thereby reducing machine noise attendant the conventional raised pressure foot during such an operation. The continuous pressure ensures proper thread tensioning throughout the travel. Moreover, the ability of the presser shoes to gradually accommodate to the changes in elevation allows continuous feeding without interruption or slowdown.

While the inclination and length of the toe and heel sections will depend on the details of the sewn construction, testing has revealed that extremely high productivity can be obtained over a wide range of fabrics and raised panels with heel and toe inclinations in the range of about $15^0$ to $45^0$, with preferred inclinations in the range of about $20^0$ to $35^0$. It is preferred to have a toe section length about the same as the center section, and a heel section of the same or shorter length. Such relationships provide affirmative pressures in the stitching area and gradual transitions between the panel surfaces. Highly satisfactory results have been demonstrated on high-speed single needle lockstitch machines using alternating presser and walking fit with a high seam pressure foot having 0.25 inch shoe widths, 0.75 inch toe section length inclined $28^0$, and a 0.32 in heel section length inclined $23^0$, and the pin 48 1 in. from the axis of the presser bar bore 22.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A presser foot of a sewing machine, comprising: a vertical body member supported for movement on a presser bar of the sewing machine reciprocating along a vertical axis and having a pair of laterally spaced forwardly extending support arms; a presser shoe pivotally connected to a front end of each support arm about a horizontal pivot member said presser shoe located entirely forwardly of the vertical axis of the presser bar, said presser shoe having a bottom surface including a horizontal center section, a forwardly and upwardly inclined front section and a rearwardly and upwardly inclined rear section; and a spring member operatively connected between each shoe and support arm effective for establishing a normal horizontal position for said center section and bidirectionally resisting pivoting of said shoe about said pivot member from said normal horizontal position.

2. The presser foot as recited in claim 1 wherein said front section is inclined in the range of about $10^0$ to $45^0$.

3. The presser foot as recited in claim 2 wherein said front section is inclined is in the range of about $20^0$ to $35^0$.

4. The presser foot as recited in claim 3 wherein said rear section is inclined in the range of about $10^0$ to $45^0$.

5. The presser foot as recited in claim 4 wherein one of said pressure shoes includes a curved downwardly and inwardly opening longitudinal recess of said center section for conforming to a welt member applied to the materials.

* * * * *